US009555934B2

(12) United States Patent
Emircan

(10) Patent No.: US 9,555,934 B2
(45) Date of Patent: Jan. 31, 2017

(54) SCREWED COVER EMBODIMENT HAVING APPARATUS OF FOIL-CUTTING AND FOLDING TO THE INNER PART IN THE ASEPTIC LIQUID CARDBOARD PACKAGES

(71) Applicant: Necat Emircan, Ankara (TR)

(72) Inventor: Necat Emircan, Ankara (TR)

( * ) Notice: Subject to any disclaimer, the term of this patent is extended or adjusted under 35 U.S.C. 154(b) by 0 days.

(21) Appl. No.: 14/429,159

(22) PCT Filed: Sep. 9, 2013

(86) PCT No.: PCT/TR2013/000289

§ 371 (c)(1),
(2) Date: Mar. 18, 2015

(87) PCT Pub. No.: WO2014/046633

PCT Pub. Date: Mar. 27, 2014

(65) Prior Publication Data

US 2015/0225133 A1 Aug. 13, 2015

(30) Foreign Application Priority Data

Sep. 21, 2012 (TR) ..... a 2012 10799

(51) Int. Cl.
*B65D 41/04* (2006.01)
*B65D 5/74* (2006.01)

(52) U.S. Cl.
CPC ..... *B65D 41/0478* (2013.01); *B65D 5/748* (2013.01); *B65D 2251/0015* (2013.01); *B65D 2251/0078* (2013.01)

(58) Field of Classification Search
CPC ..... B65D 5/746–5/748; B65D 41/0478; B65D 55/022; B65D 55/026; B65D 2251/0015; B65D 2251/0078
USPC ... 215/228, 250–253, 257, DIG. 8; 220/212, 220/253, 254.3, 254.8, 266, 367.1; 222/81, 83, 222/483–484, 519, 541.1–541.2, 541.5–541.6, 222/547.562, 568; 229/125.15, 215.04
See application file for complete search history.

(56) References Cited

U.S. PATENT DOCUMENTS 5,833,112 A * 11/1998 Pape ..... B65D 5/748 220/258.2
6,223,924 B1 * 5/2001 Ek ..... B65D 5/748 215/230
6,431,384 B1 * 8/2002 Dubach ..... B65D 5/748 220/258.5
6,745,923 B2 * 6/2004 Julian ..... B65D 5/748 220/255.1

(Continued)

FOREIGN PATENT DOCUMENTS

DE 69803582 T2 10/2002
DE 69903815 T2 2/2003

(Continued)

OTHER PUBLICATIONS

International Search Report for corresponding International Application No. PCT/TR2013/000289.

*Primary Examiner* — J. Gregory Pickett
*Assistant Examiner* — Brijesh V. Patel
(74) *Attorney, Agent, or Firm* — Egbert Law Offices, PLLC

(57) ABSTRACT

A cover embodiment is provided to be used especially in aseptic cardboard liquid packages and to provide ease of use and it provides the flowing mouth to open in a maximum level by creating a homogeneous structure on the liquid flowing mouth thanks to the items located inside and enabling the aluminum foil part left inside the cardboard to be compressed between the package and the cover embodiment.

1 Claim, 13 Drawing Sheets

(56) References Cited

U.S. PATENT DOCUMENTS

| | | | | |
|---|---|---|---|---|
| 7,549,558 | B2 * | 6/2009 | Weist | B65D 5/748 220/267 |
| 7,886,922 | B2 * | 2/2011 | Seelhofer | B65D 5/748 215/249 |
| 7,934,616 | B2 * | 5/2011 | Felber | B65D 5/748 220/254.3 |
| 2005/0242113 | A1 * | 11/2005 | Weist | B65D 5/748 222/83.5 |
| 2006/0071000 | A1 * | 4/2006 | Weist | B65D 5/748 220/278 |
| 2012/0228295 | A1 * | 9/2012 | Emircan | B65D 5/747 220/254.1 |

FOREIGN PATENT DOCUMENTS

| | | | | |
|---|---|---|---|---|
| FR | 2766464 | A1 | 1/1999 | |
| FR | WO 9962775 | A1 * | 12/1999 | B65D 5/748 |
| WO | 2012122662 | A1 | 9/2012 | |

* cited by examiner

SCREWED COVER EMBODIMENT HAVING APPARATUS OF FOIL-CUTTING AND FOLDING TO THE INNER PART IN THE ASEPTIC LIQUID CARDBOARD PACKAGES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to cover embodiment, which is used in aseptic liquid cardboard packages, forms a flowing hole on the top part of the package so that the liquid inside the cardboard package can flow through, and can be screwed once more.

2. Description of Related Art Including Information Disclosed Under 37 CFR 1.97 and 37 CFR 1.98

In the currently used aseptic liquid cardboard package covers, various shapes of configurations have been applied. Some of these can be opened with the help of hinges and the aluminum foil that is previously attached on the package is broken off by hand after opening the upper cover, and thus they are made functional. In some embodiments, on the other hand, a hole is created, which enables the liquid to flow into the cover by piercing the foil part of the package as a result of pressing a plastic piece having incisors for piercing the foil located inside the cover, in the downward direction.

In some cover embodiments, on the other hand, the covers are provided to operate with a screwed system which is made of two- or three-piece plastic. On the part of the package under the cover, which has been previously prepared on the cardboard, the foil and the polyethylene layer are left in a one-piece structure so that they can pass through the cardboard in one-piece form while the cardboard laminations (layers) are being made, and this system is an embodiment which is safer compared to the other embodiments, and provides asepticity. Moreover, as these types of screwable covers are covered by being screwed again, it has become much easier to carry the products, and impermeability is provided.

The working system of the screwed covers which consist of three parts, is that the bottom and upper part are screwed in nested form and a third part is located in the center, and when the cylindrical cover having incisors at the bottom part is rotated in the opening direction, it progresses in the downward direction, and cuts the foil on the cardboard by rotating and therefore it pierces the part inside the cover of the package. In such types of cover embodiments, the applications numbered PCT/JP2004/014333, EP1820742 A1, PCT/EP03/50614 can be considered as example. In these two-piece covers, on the other hand, the cylindrical part located at the center is rotated; the plate or plates connected to the outer cover having flat incisors located on the lower part of the cover is/are pushed in the downward direction, the foil part of the package is made to be broken into pieces as much as the number of plates, and thus it is opened.

In that kinds of screwed covers consisting of two pieces, on the other hand, the cover embodiment presses the flat plate having incisors in the downward direction and provided pierce of the aluminum layer on the package when the cover embodiment is rotated in the opening direction thanks to foil protrusion provided at the upper section of flat plate having incisors, which is connected to the sides within the section attached to the lower package and protrusion being suitable with foil protrusion designed in the upper screwed cover; however, a completely homogeneous flowing hole cannot be opened as the opening process is not completed.

This case has restricted the product flow and made the usage difficult.

In the above-mentioned cover embodiments, on the other hand, after the foil available on the flowing mouth is cut, the part of the foil which is broken off stuffs up the flow net because of the pressure inside the box, and sometimes the foil piece falls into the liquid product, which causes undesired results.

As the cover height should be higher because of the rotation process of the parts having cylindrical incisors in the inner part of such type of screwable covers, it becomes quite difficult for them to be stored, transported and ordered on the shelves. Moreover, because of huge cover sizes and more number of parts, the amount of raw material used increases, which makes it economically non-efficient and thus, it is not that economic in efficient use of the resources.

Object of the Invention

The object of the invention is to provide a much more apparent flowing ease compared to the other embodiments during the product flow by taking the foil totally away from the flowing mouth, and by opening at least 90% of the inner wall in a homogeneous structure.

BRIEF SUMMARY OF THE INVENTION

In order to achieve the above-mentioned object, the present invention relates to a screwed cover embodiment having apparatus of foil-cutting and folding to the inner part in the aseptic liquid cardboard packages, comprising lower cover, cylindrical ridge and flat plate located on the inner part of the lower cover; axial hinge and tension spring connected to the cylindrical wall in the lower cover; upper cover and spiral friction ramp located on the inner part of the upper cover.

In order to achieve said objects, there is a cylindrical ridge located on the inner part of the lower cover which is exposed to the pressure that the spiral friction ramp will apply in the downward direction after it is rotated in the cover-opening direction. Moreover, the left and right flat plates on which the cylindrical ridge on the inner part of the lower cover is located are connected to the cylindrical wall inside the lower cover by means of axial hinge. The connection of said flat plates to the cylindrical inner wall with an asymmetrical parallel angle via axial hinge is provided by means of the tension spring.

DESCRIPTION OF PART REFERENCES

Figure 1:
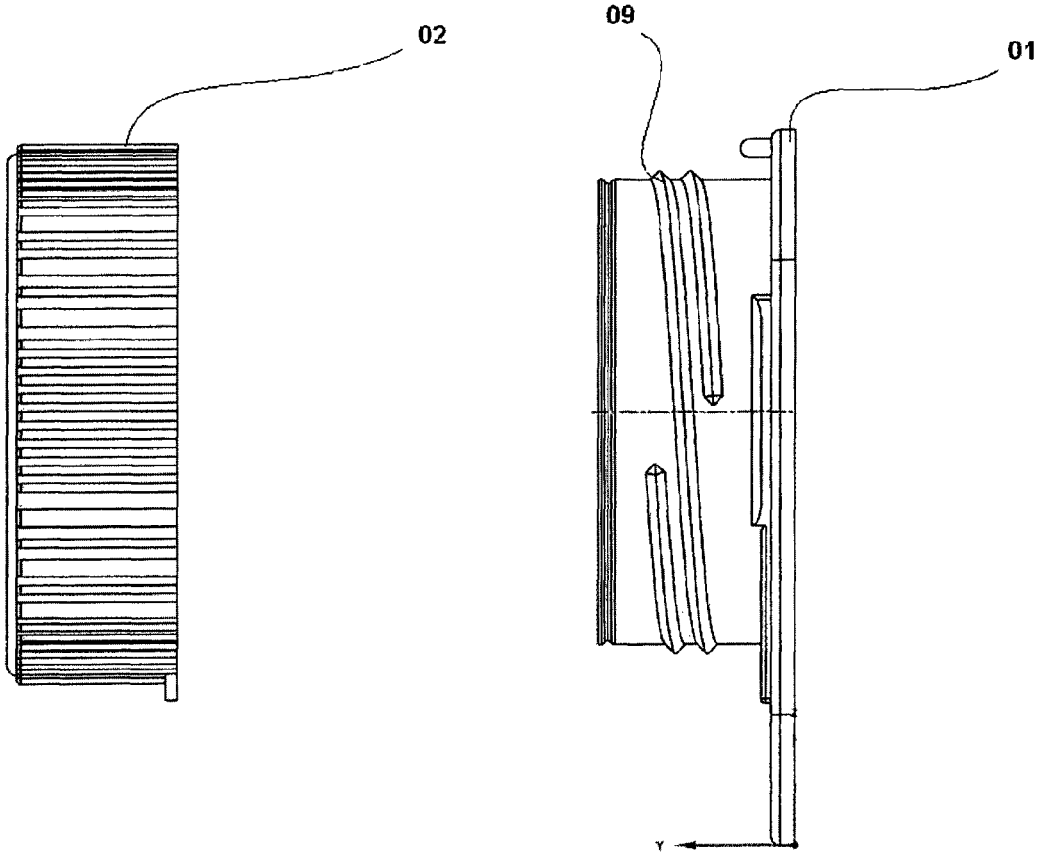
FIG. 1 is the view of the preferred embodiment of the cover embodiment (101) according to the present invention from the side profile.

101. Cover embodiment
01: Lower cover
02: Upper cover
03: Cylindrical ridge
04: Tension springs
05: Axial hinges
06: Drainage protrusion 1
07. Drainage protrusion 2
08: Spiral friction ramp
09: Screwing threads (lower)
10: Cylindrical body
11: Screw threads (upper)
12: Incisors
13: Flat plates
14: Cylindrical wall
15: Aseptic cardboard box

DETAILED DESCRIPTION OF THE INVENTION

The present invention relates to a screwed cover embodiment (101) having apparatus of foil-cutting and folding to the inner part in the aseptic liquid cardboard packages, comprising lower cover (01), cylindrical ridge (03) and flat plate (13) located on the inner part of the lower cover (01); axial hinge (05) and tension spring (04) connected to the cylindrical wall (14) in the lower cover (01); upper cover (02) and spiral friction ramp (08) located on the inner part of the upper cover (02).

When said spiral friction ramp (08) rotated in the cover-opening direction, it applies a pressure in the downward direction. Cylindrical ridge (03) located on the inner part of the lower cover (01) is exposed to this pressure.

The connection between the right and left flat plates (13) on which the cylindrical ridge (03) provided on the inner part of lower cover (01) is located and the cylindrical wall (14) inside the lower cover (01) is provided by means of the axial hinge (05). Moreover, a tension spring (04) which provides the connection of said flat plates (13) to the inner wall (14) with an asymmetrical parallel angle by means of the axial hinge (05), is used.

The cover embodiment (101) according to the present invention comprises a surface which will be attached on the surface of the cardboard package (15) forming the lower cover (01); a cylindrical body (10) to make the upper cover (02) screwed; cylindrical ridge (03) located in the middle of this cylindrical body (10) and flat plates (13) adjacent to the protrusions on both sides of this cylindrical ridge (03); incisors (12) ordered all around the lower part of the flat plates (13); axial hinges (05) connecting all these channel, plates and incisors to the cylindrical inner wall (14) from two points and tension springs (04) providing pushing and drawing force in a form inclined 90 degree located asymmetrically with different angles from different points by means of the axial hinges (05) connected to the inner wall (14) from two sides, which can rotate the embodiment 90 degree, to which these axial hinges (05) are connected; drainage protrusions (06-07) located at the front and back part on the cylindrical ridge (03) in the middle of the flat plates (3); screwable upper cover (02) and spiral friction ramp (08) on the inner part of this upper cover (02) embodiment; screwing threads (09-11) parallel to each other on the lower cover (01) and upper screwable cover, which provide this spiral friction ramp (08) to rotate. As a result of the calculations conducted, it has been found out that this embodiment provides an ease of flowing which is much more evident compared to the other embodiments while the product is flowing after the opening and homogeneous opening of at least 90% of the inner wall of the lower cover by taking the foil away from the flowing mouth.

When the upper cover (02) and the lower cover (01) are in a closed position, when the upper cover (02) is rotated in the opening direction, the spiral friction ramp (08) on the inner part of the upper cover (02) applies pressure on the lower flat plates (13) in the downward direction thanks to the spiral height of the spiral friction ramp (08) on the inner part of the upper cover (02) by rubbing onto the upper part of the cylindrical ridge (03) located in the middle of the inner wall (14) of the lower cover (01). Because of this pressure, the incisors (12) ordered all around the flat plates (13) create holes on the foil. On the foil, a hole is created in the form of the inner wall (14) of the lower cover (01), and a pressure is applied until it will be curved downwards with 30 degree. The movement of the spiral friction ramp (08) to the left and right because of the pressure applied is prevented by the drainage protrusion (06) located on the cylindrical ridge (03) and on the front part, and it is provided to progress on the same line. Following the 180-degree rotation in the opening direction, the spiral friction ramp (08) on the inner part of the upper cover (02) rests on the second drainage protrusion (07) located on the upper part of the cylindrical ridge (03) in the middle of the lower cover (01) and on the back part, pushes the flat plates (13) opening the foil in the downward direction, and enables it to be dragged until it reaches the 90-degree position. The flat plates (13) and the lower cover (01) are provided to rotate in the same axis thanks to the axial hinges (05) located onto the inner wall (14). Thanks to the tension springs (04) connected to the flat plates (13) located in the middle of the lower cover (01) with in the inner wall (14) of the lower cover (01), the flat plates (13) which are provided to progress 90 degree in the backward direction are totally taken away from the flowing mouth, and therefore a homogeneous flowing mouth is obtained.

After the 360-degree rotation of the upper cover (02) on the cardboard package (15) is completed, the inner mechanism on the lower cover (01) is folded into the cardboard package (15) with 180 degrees, and therefore, makes the 90% of the flowing mouth open by compressing the foil between the mechanism and the cardboard package (15). Thus, both an ease of flowing is obtained, and the flowing mouth of the foil is prevented from getting closed.

The embodiment within the cover is an embodiment enabling cylindrical ridge (03) mechanism, the lower part of which is hollow, to be rotated 180 degrees.

Figure 2:
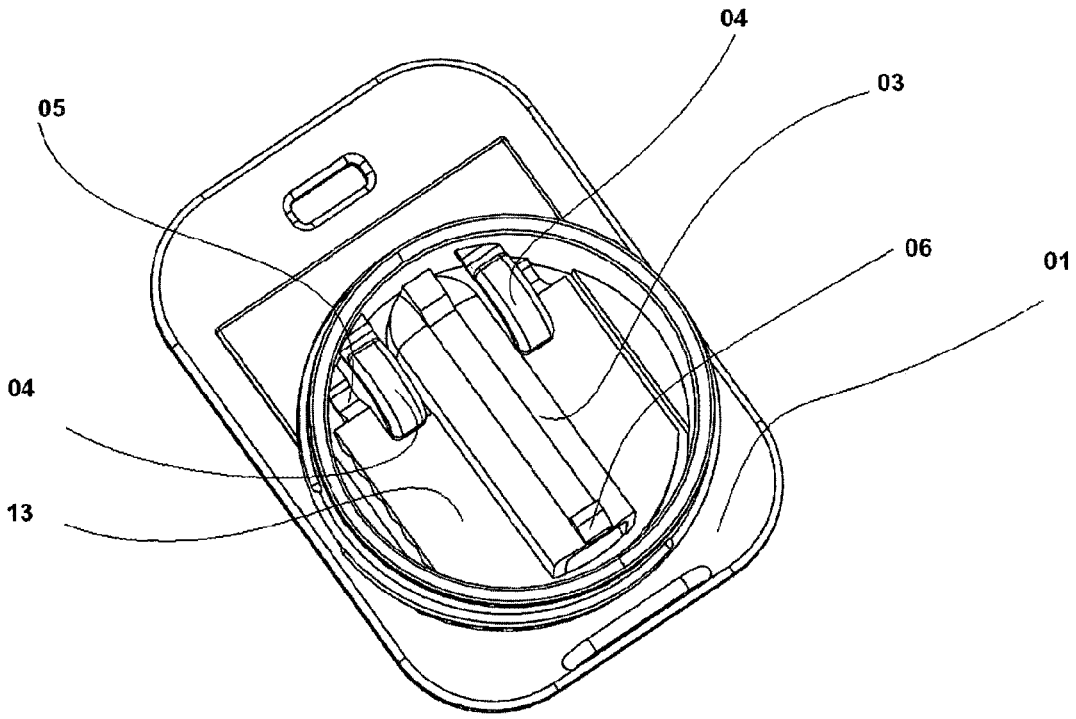
FIG. 2 is the top perspective view of lower cover (01) of the preferred embodiment of the cover embodiment (101) according to the present invention.
Figure 3:
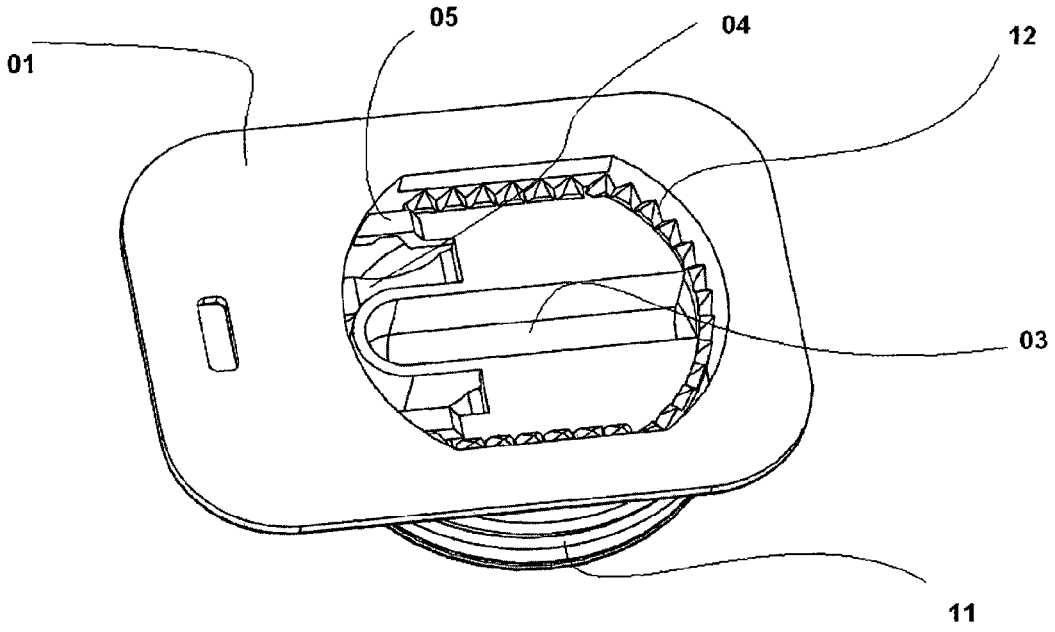
FIG. 3 is the bottom perspective view of the lower cover (01) of the preferred embodiment of the cover embodiment (101) according to the present invention.
Figure 4:
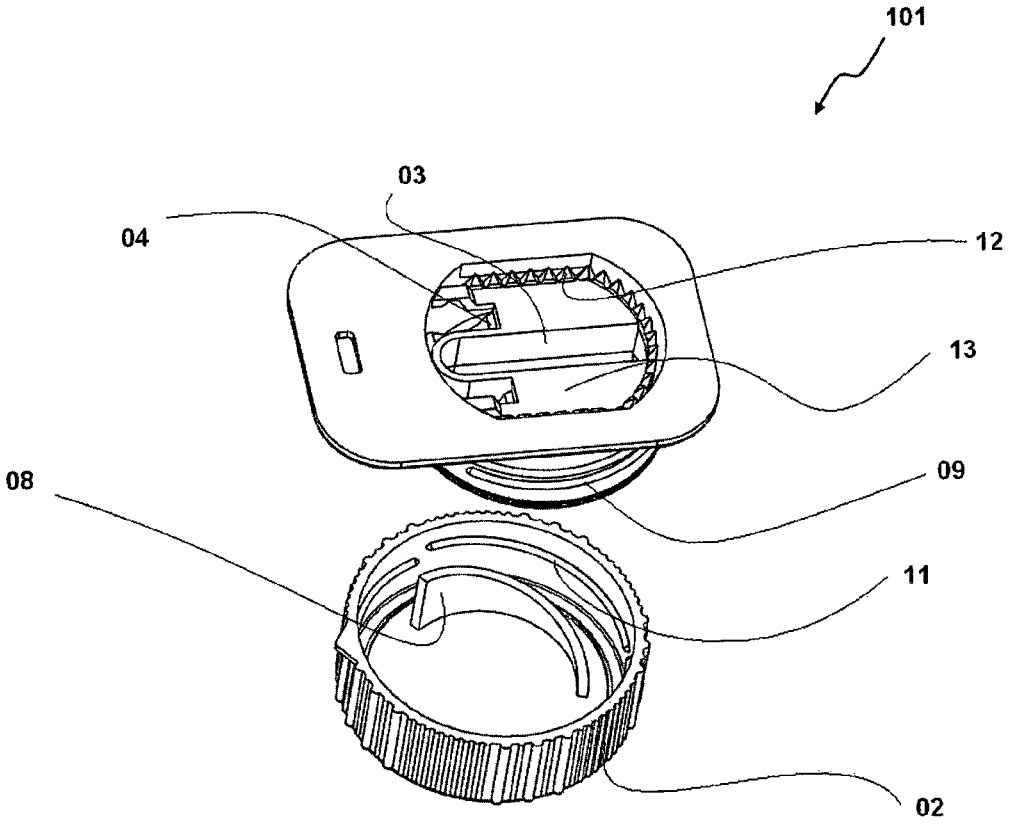
FIG. 4 is the bottom perspective view of the lower cover (01) and the upper cover (02) of the preferred embodiment of the cover embodiment (101) according to the present invention.
Figure 5:
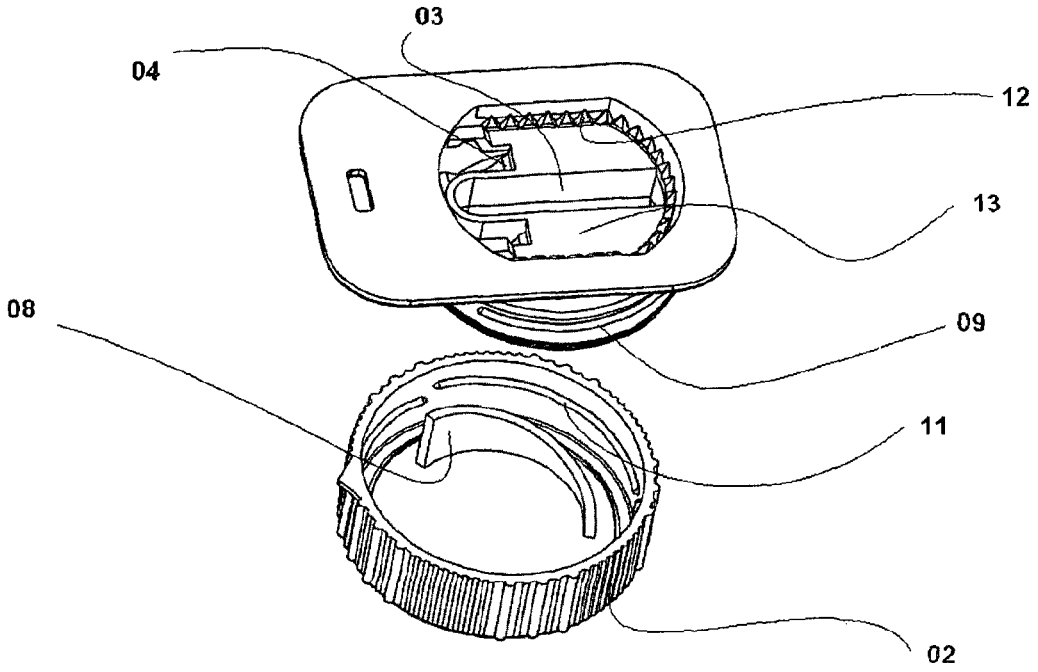
FIG. 5 is the inner part profile view of the upper cover (02) of the preferred embodiment of the cover embodiment (101) according to the present invention.
Figure 6:
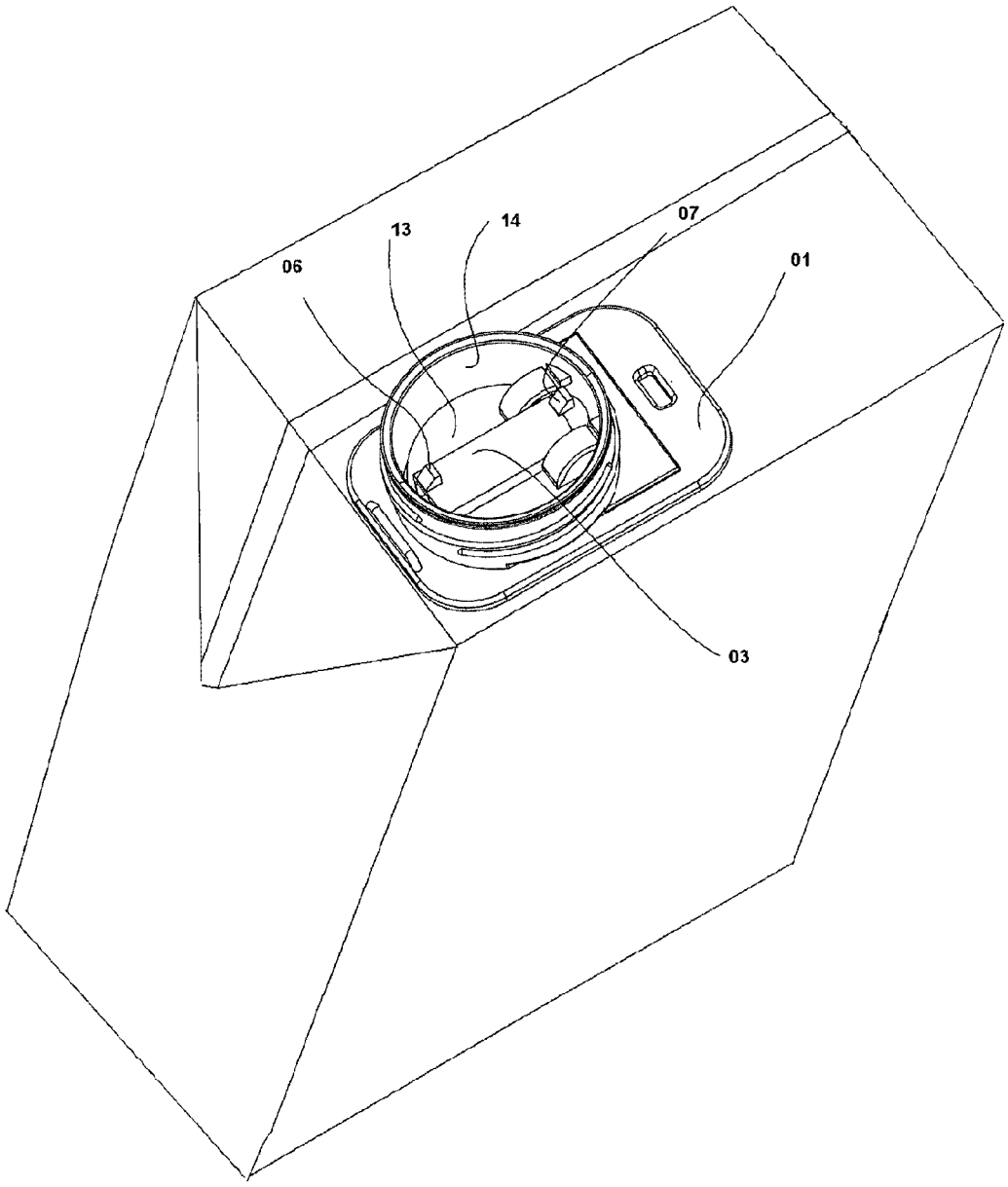
FIG. 6 is the perspective view of the lower cover (01) installed on the cardboard box (15) of the preferred embodiment of the cover embodiment (101) according to the present invention.
Figure 7:
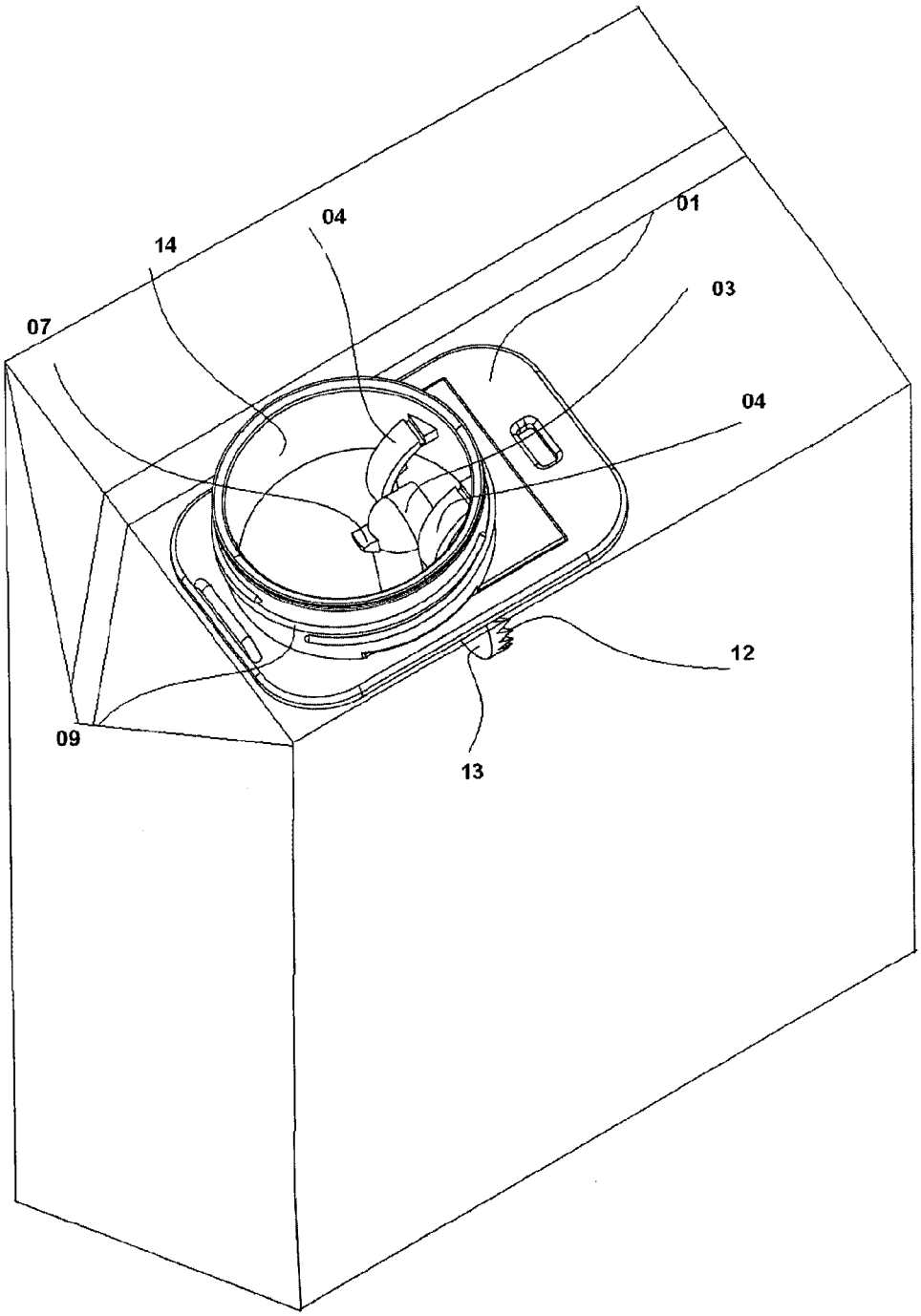
FIG. 7 is the perspective view of the inner mechanism (03, 04, 05, 13) of the lower cover (01) which is installed on the cardboard box (15) of the preferred embodiment of the cover embodiment (101) according to the present invention, when it is semi-open together.
Figure 8:
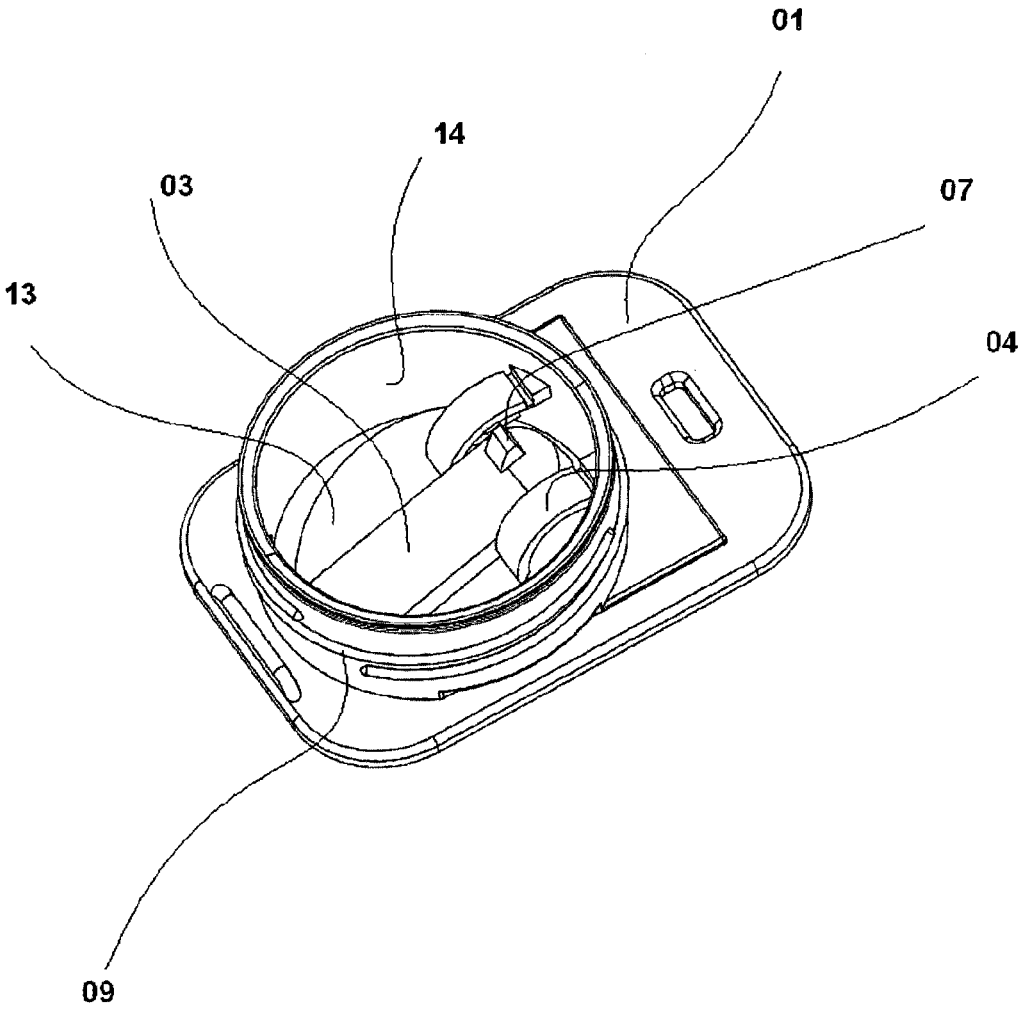
FIG. 8 is the top perspective view of the lower cover (01) of the preferred embodiment of the cover embodiment (101) according to the present invention.
Figure 9:
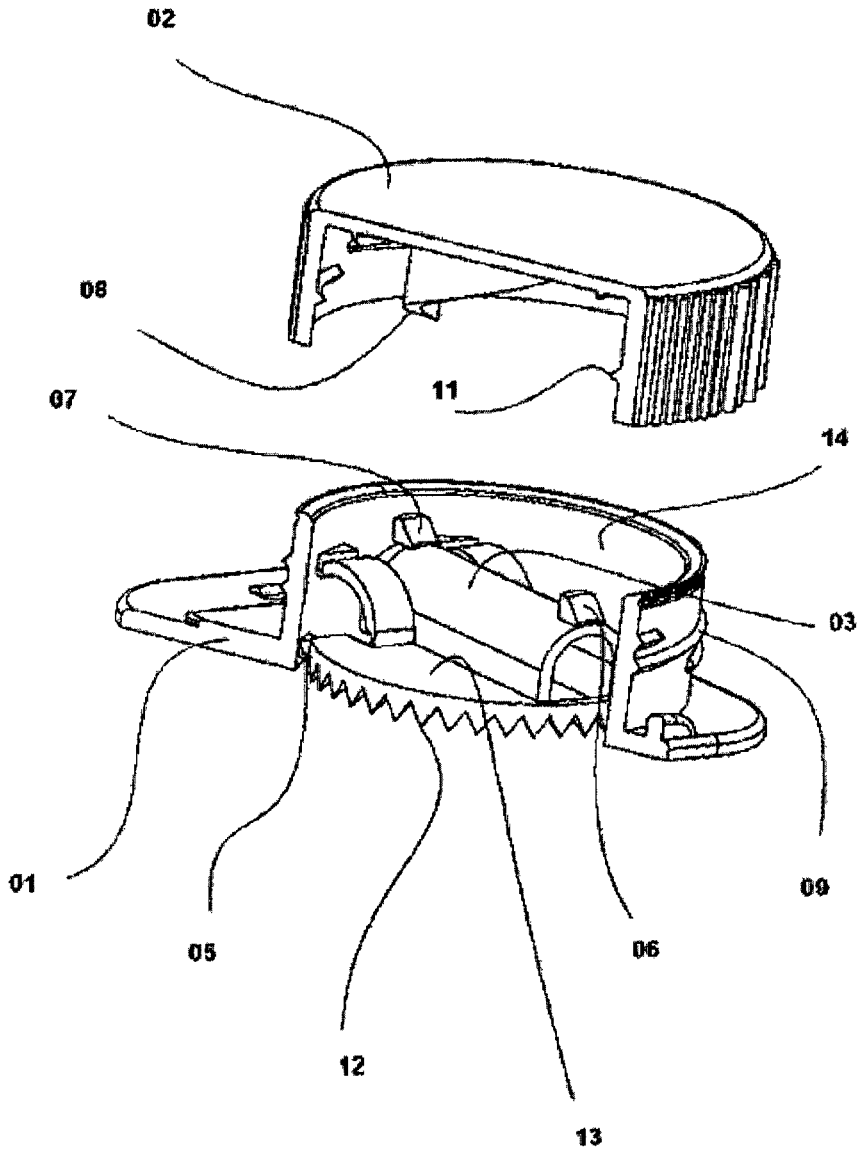
FIG. 9 is the perspective sectional view of the upper (02) and lower (01) covers of the preferred embodiment of the cover embodiment (101) according to the present invention.
Figure 10:
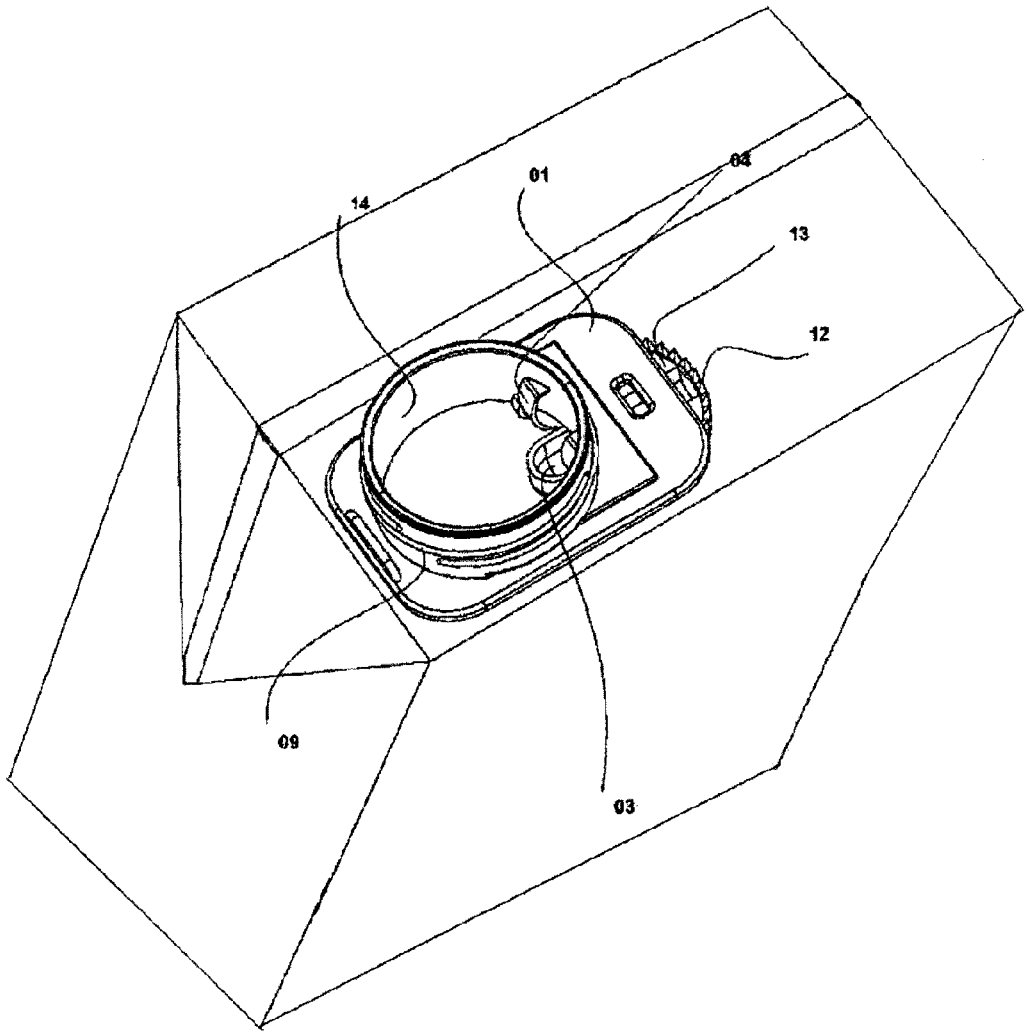
FIG. 10 is the perspective sectional view showing how the inner mechanism of the upper (02) and lower (01) covers of the preferred embodiment of the cover embodiment (101) according to the present invention operate.
Figure 11:
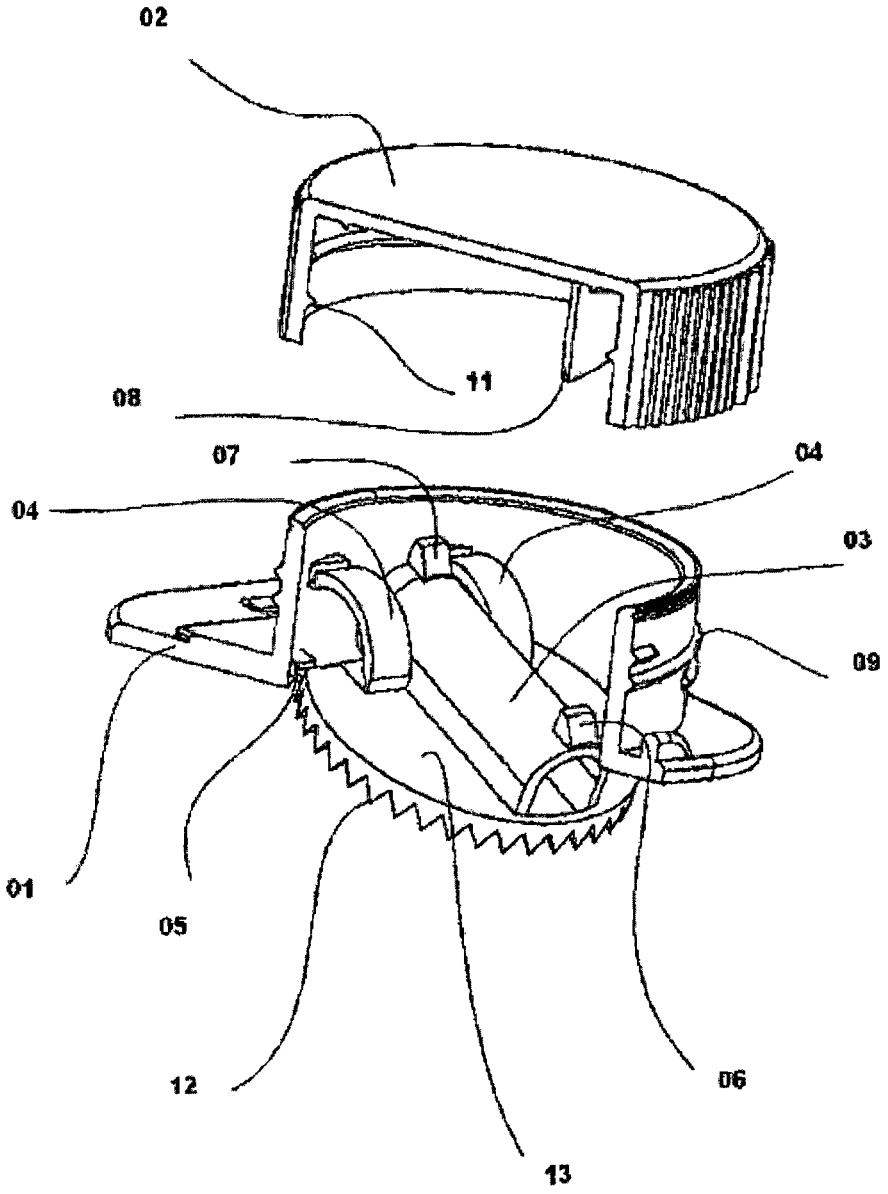
FIG. 11 is the perspective sectional view showing how the inner mechanism of the upper (02) and lower (01) covers of the preferred embodiment of the cover embodiment (101) according to the present invention operate.
Figure 12:
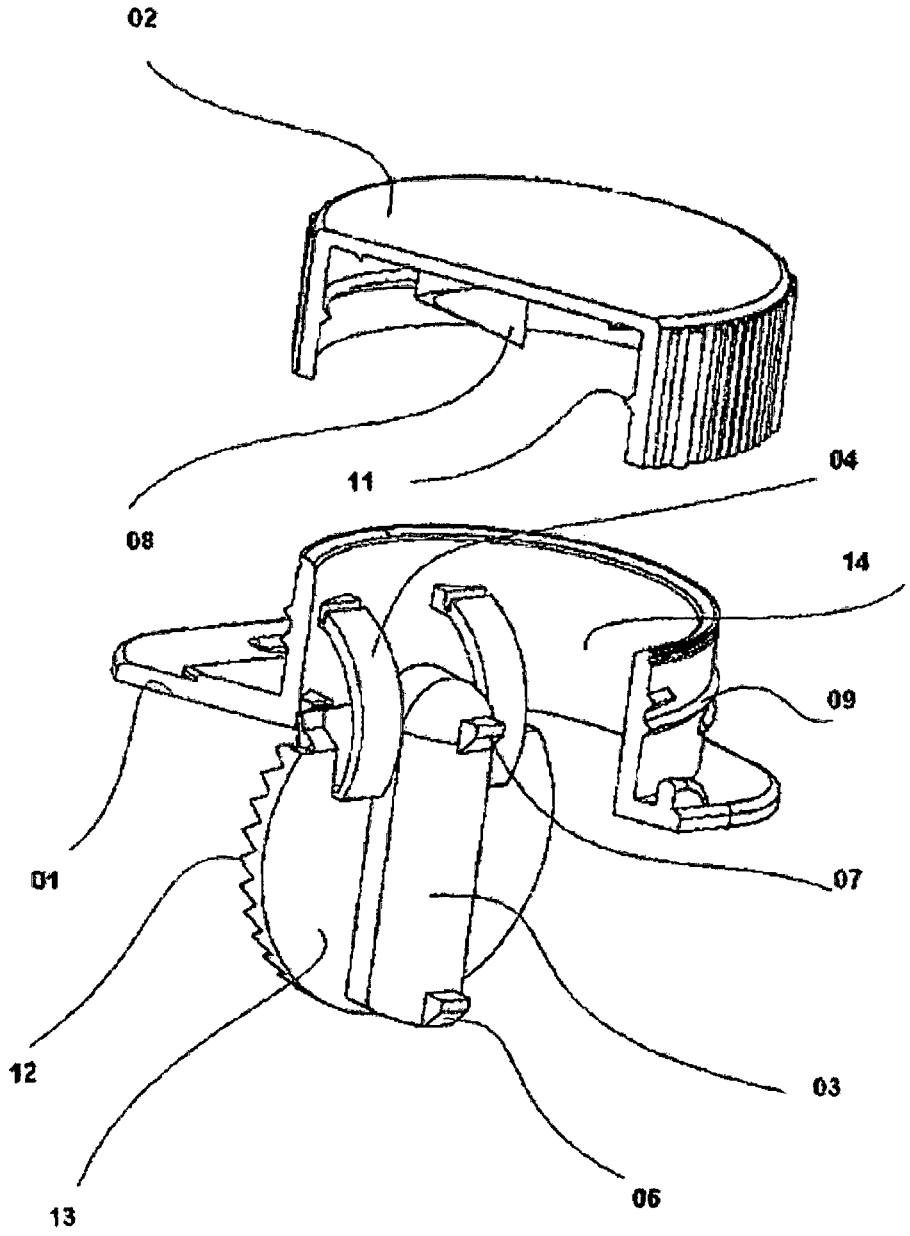
FIG. 12 is the perspective sectional view showing how the inner mechanism of the upper (02) and lower (01) covers of the preferred embodiment of the cover embodiment (101) according to the present invention operate, as a continuation of FIG. 11.
Figure 13:
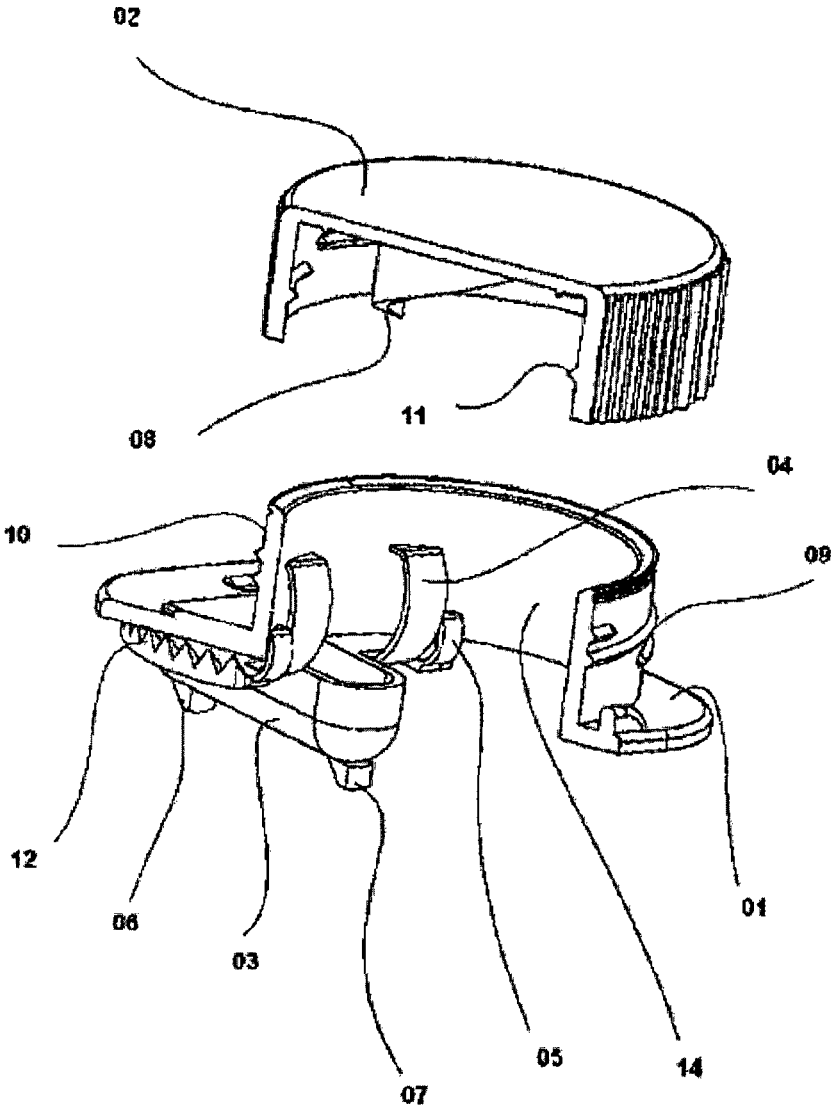
FIG. 13 is the perspective sectional view showing how the inner mechanism of the upper (02) and lower (01) covers of the preferred embodiment of the cover embodiment (101) according to the present invention operate, as a continuation of FIG. 12.

It is illustrated with the drawings (FIG. 1-13) that the operation of the mechanism is designed specifically and the items in the current embodiment constitute a whole. It is provided that the cover embodiment (101) consists of two pieces, and the inner mechanism rotates 180 degree with this configuration. Therefore the resources are used more efficiently, and the product is used in a more functional manner.

ADAPTATION OF THE INVENTION TO THE INDUSTRY

It is a cover embodiment which can be produced with the plastic injection molding method so as to be used in aseptic cardboard packages, attached onto the cardboard package with the help of an installation machine as in the other cardboard package covers, minimizing the raw material usage as its number of parts is quite low thanks to the functional characteristics of its design.

The invention claimed is:

1. A screwed cover apparatus that provides foil-cutting and folding of the foil to an inner part of an aseptic liquid cardboard package, the screwed cover apparatus comprising:

a lower cover;

an upper cover;

a spiral-shaped friction ramp located on an inner part of said upper cover;

a cylindrical ridge in an inner portion of said lower cover, said cylindrical ridge being exposed to pressure from said spiral-shaped friction ramp applied after rotating in a cover-opening direction;

a right flat plate and a left flat plate on which said cylindrical ridge positioned in an inner part of said lower cover is located;

an axial hinge connecting said right flat plate and said left flat plate to a cylindrical inner wall of said lower cover; and a tension spring connected to said cylindrical inner wall of said lower cover with said right flat plate and said left flat plate in an asymmetrical parallel angle so as to connect the right flat plate and the left flat plate to said cylindrical inner wall by said axial hinge to provide 180° rotation of the right flat plate and the left flat plate into the cardboard package.

* * * * *